US006439996B2

(12) United States Patent
LeMay et al.

(10) Patent No.: US 6,439,996 B2
(45) **Date of Patent: *Aug. 27, 2002**

(54) KEY FOR A GAMING MACHINE AND METHOD OF USE THEREOF

(75) Inventors: Steven G. LeMay; Jamal Benbrahim, both of Reno, NV (US)

(73) Assignee: IGT, Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/338,173

(22) Filed: Jun. 22, 1999

(51) Int. Cl.[7] ..... G07C 9/00

(52) U.S. Cl. ..... 463/29

(58) Field of Search ..... 463/29; 235/380

(56) References Cited

U.S. PATENT DOCUMENTS

| | | | | | |
|---|---|---|---|---|---|
| 4,072,930 | A | * | 2/1978 | Lucero et al. | 340/152 T |
| 4,575,621 | A | * | 3/1986 | Dreifus | 235/380 |
| 5,371,345 | A | * | 12/1994 | LeStrange et al. | 235/380 |
| 5,429,361 | A | * | 7/1995 | Raven et al. | 273/138 A |
| 5,879,234 | A | * | 3/1999 | Mengual | 463/20 |
| 5,890,439 | A | * | 4/1999 | McGunn | 109/47 |
| 5,954,576 | A | * | 9/1999 | Coulter et al. | 453/17 |
| 5,954,583 | A | * | 9/1999 | Green | 463/29 |

* cited by examiner

*Primary Examiner*—Valencia Martin-Wallace
*Assistant Examiner*—Carmen D. White
(74) *Attorney, Agent, or Firm*—Beyer Weaver & Thomas, LLP

(57) ABSTRACT

A key for a gaming machine for authorizing various functions via a control system of the gaming machine. The key includes a connector for coupling the key to a communication port of the gaming machine and non-volatile memory that communicates with the control system to determine the appropriateness of authorization and the functions authorized.

22 Claims, 1 Drawing Sheet

KEY FOR A GAMING MACHINE AND METHOD OF USE THEREOF

BACKGROUND OF THE INVENTION

1. Field of the Invention

The present invention pertains to a key for use with a gaming machine, and more particularly, to an electronic key for a gaming machine that authorizes a user to perform various functions.

2. Description of the Prior Art

The gaming industry is subject to strict regulations and supervision by various regulatory agencies. This is obviously necessary for integrity and fairness within the overall gaming industry. Thus, gaming machines are designed with many safeguards to prevent unauthorized interference with their functioning.

Among the safeguards employed for gaming machines are the use of mechanical locks. For instance, each gaming machine generally includes a door that may be opened to provide access to the internal workings of the gaming machine, including the coin hopper and bill stacking mechanism on the bill validator for collection, addition and removal of money. Generally, inside the gaming machine is a second door that includes a second mechanical lock and in some jurisdictions, even a third mechanical lock, which provides access to the gaming machine's control system.

Within the gaming machine's control system is the general processing platform. This processing platform includes processing necessary for controlling various aspects of the gaming, i.e., paytables, random number generation, payout history, money intake history, game selection among a variety of games to be played on the machine, etc. Thus, the need for adequate security in order to avoid interference with these various functional aspects of the gaming device is apparent.

Currently, one way in which gaming machines protect their gaming processes include the use of a "key chip." With a key chip, the door of the gaming machine is unlocked and opened, typically with a mechanical key. The access door to the control system is also unlocked and opened with, generally, a mechanical key and the main processing platform or board is removed from the control system. Existing, installed EPROM(s) are then removed for a short period of time, special EPROM(s) are inserted in their place and activated when the processing platform is replaced. These special EPROM(s) modify non-volatile RAM. Once modification is complete, the special EPROM(s) are removed and the original EPROM(s) are reinstalled. The machine recognizes the changes and enters a special configuration mode. This mode allows various secure, gaming functions and processes to be accessed and/or altered. As is readily apparent, this process is time consuming, labor intensive and causes premature hardware failures due to excessive insertion/removal, which can lead to bent pins, damaged sockets, etc. Furthermore, the EPROM(s) themselves are also easily prone to copying.

SUMMARY OF THE INVENTION

In accordance with the present invention, a key for use with a gaming machine for authorizing performance of at least one function of the gaming machine via a control system of the gaming machine includes a body, a connector for connection of the key to the gaming machine, and a memory device. The memory device is configured to authorize the control system to allow a user to perform at least one function.

In accordance with one aspect of the present invention, a key in accordance with the present invention authorizes a user to perform at least one of changing paytables, changing games, verifying firmware, verifying software, downloading to media from an external source, clearing RAM within the control system, clearing content of a modifiable storage device, or other secure transactions. In regulated jurisdictions, these actions are normally subject to various regulations.

In accordance with another aspect of the present invention, the key further includes non-volatile memory that is coupled to the body and receives information from the control system. The key may also include a processor used to execute hashing, decryption or any other required security processing.

Thus, a key in accordance with the present invention allows for quick, easy, yet secure access to protected gaming features and processes. Furthermore, a key in accordance with the present invention helps reduce hardware failures attributable to the continuous removal and insertion of EPROM(s) on current gaming processing platforms.

DETAILED DESCRIPTION OF THE PREFERRED EXEMPLARY EMBODIMENTS

Figure 1:
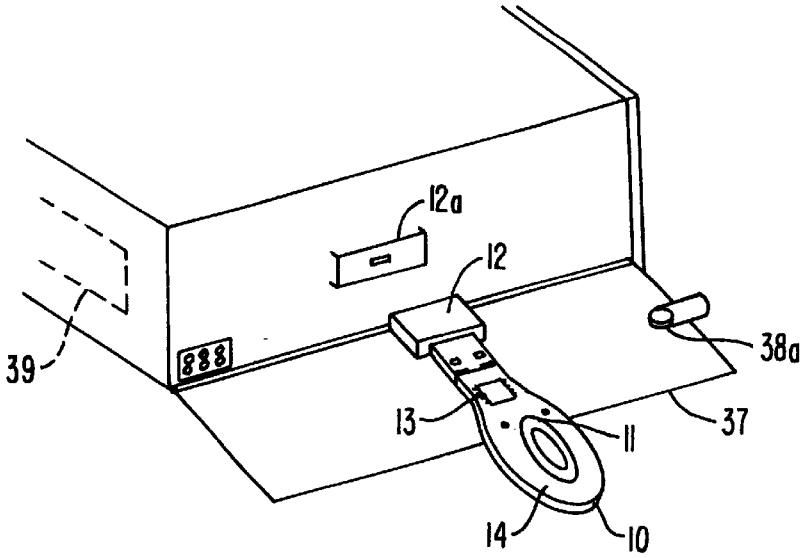
FIG. 1 is a schematic illustration of a key for a gaming machine in accordance with the present invention.

With regard to FIG. 1, an electronic key 10 for use with a gaming machine for authorizing performance of at least one function of the gaming machine is illustrated. The key 10 preferably includes a body 11, a connector 12, and non-volatile memory 13, such as, for example, ROM, flash RAM or EPROM. Furthermore, key 10 preferably includes a housing 14. Key 10 may also include a processor for providing various functions such as, for example, hashing, decryption or any other required security processing, and other gaming operations such as, for example, random number generation.

Connector 12 is located at a distal end of the key and is configured to connect or couple the key to the gaming machine via an appropriate communication port 12*a* located on or within the gaming machine. In a preferred embodiment, the port is preferably a universal communication port. Preferably, connector 12 is a universal serial bus (USB) connector.

The body is preferably an appropriate transmission medium, such as a circuit board, for transmitting information between non-volatile memory 13 and connector 12.

Figure 2A:
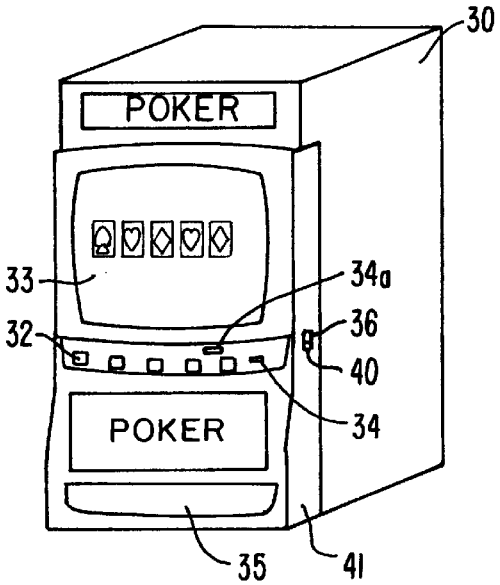
FIG. 2A is a schematic illustration of a gaming machine system in accordance with the present invention.
Figure 2B:
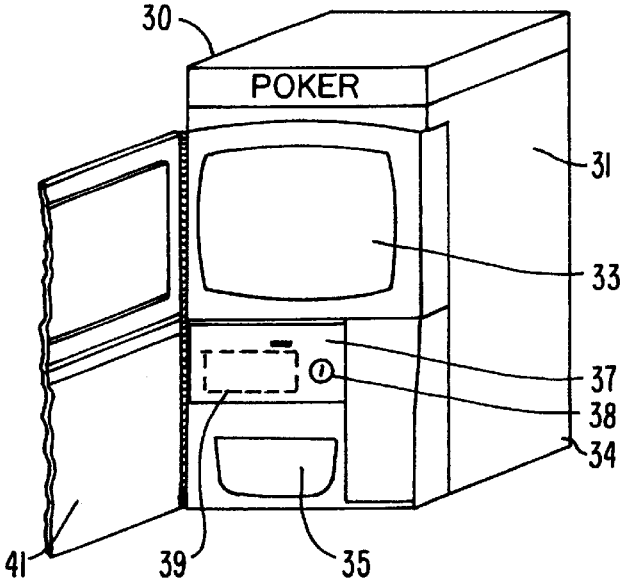
FIG. 2B is a schematic illustration of a gaming machine system in accordance with the present invention with a door open.

FIGS. 2A and 2B illustrates a gaming machine 30 that includes a housing 31, at least one user input 32 coupled to the housing, a display 33, such as, for example, a CRT, LCD or plasma display, coupled to the housing, a bill acceptor 34, a coin slot 34*a* for accepting coins and a money output 35. The gaming machine also includes a control system 39. A door 41 is included for permitting access to the gaming machine. A lock 36 controls the locking of the door to thereby control access to the gaming machine. An interior door 37 is generally included for permitting access to the control system. Generally, there is at least one lock 38 for controlling the interior door and thereby access to the control system. In some gaming jurisdictions, a second lock (not shown) is also required for the interior door.

In accordance with a preferred embodiment of the present invention, lock 38 on interior door 37 is a corresponding port for receiving connector 12 of key 10. Alternatively, a mechanical or electronic lock 38*a* may be used to control door 37 and thereby access to communication port 12*a*.

Upon insertion of the electronic key into communication port 12*a*, control system 39 will read non-volatile memory 13 on the key, or communicate with the key, which may involve hashing, encryption, decryption or other security measures, and it will allow secured access to the control system. Furthermore, control system 39, may, upon confirming access, permit the user of the key to perform one or more privileged options, i.e., "restricted" or secure options. These privileged options may include, for example, clearing RAM within the control system, changing paytables, changing games, verifying firmware, verifying software, downloading to media from an external source, obtaining game playing history, obtaining information regarding money in and out of the gaming machine, etc. Such authorization for performing privileged options may be provided by granting specific access to the control system by opening the interior door, or alternatively, may be provided through an on-screen menu on the display. The on-screen menu could be manipulated through various methods known in the art such as the display being a touch screen, by using user inputs located on the gaming machine or coupling user inputs to the gaming machine or via a network connection. The user inputs may include, for example, a keyboard, a mouse, etc.

In accordance with an alternative embodiment, key 10 includes modifiable memory or storage coupled to body 11. With such an alternative embodiment, control system 39 of the gaming machine is able to write or transfer information to the key such as, for example, actions performed, times performed, money removed, money added, games changed, games selected, game playing history, etc. Such information could then be transferred to a central control system (not shown) for further use. The modifiable memory or storage may or may not be cleared by the gaming machine when the key is coupled thereto and thus may remain intact in the key until the modifiable storage is cleared. Examples of such modifiable storage include battery backed RAM, one-time programmable memory, flash RAM.

In accordance with another alternative embodiment, in the instance when lock 36 is configured to receive key 10, lock 36 may be configured for determination of unauthorized tampering or entry has been attempted. Lock 36 may be covered with, for example, evidence tape which generally will indicate if the lock has been tampered with. Another example of configuring lock 36 includes equipping the lock with a sensor 40, which would indicate any type of tampering, including authorized or unauthorized. Control system 39 could then store information to non-volatile RAM located on key 10 regarding attempted manipulations of lock 36. Since records would generally indicate authorized "tamperings" of lock 36, it will be readily apparent if unauthorized "tamperings" took place in-between. Control system 39 could also communicate the access attempt to a host system or set off alarms when appropriate.

While the present invention has been described for use with a gaming machine, it should be readily apparent to those skilled in the art that it may also be used with a gaming system consisting of one or more gaming machines or stations.

The key may be coupled to a remote system and its information transferred securely to the gaming machine or gaming machine system. For example, the key may be coupled to a central computer or network system that is coupled to the gaming system via a network connection. Thus, the key may be used to control one or more gaming machines via the central computer or network system.

An electronic key in accordance with the present invention may be configured to perform or authorize performance of numerous functions. For example, if the key includes a processor, the key may perform, for example, hashing, encryption, decryption, and date manipulation. Furthermore, the key may cause the gaming machine or system to automatically perform designated functions once the key is recognized and verified, such as, for example, performing internal verifications.

The key may also be configured to perform or authorize performance of non-secure functions.

The key may also be coupled to the gaming machine or system via other appropriate means such as, for example, a keyboard; serial port, parallel port, firewire, or ethernet. Additionally, key 10 may consist of a smart card and thus would be coupled to the gaming machine or system via a smart card reader.

The key may also be left coupled to the communication port during normal operations of the gaming machine or system to provide information or security services, such as, for example, encryption/decryption information for the gaming machine.

The key may also include a real time clock.

Accordingly, the present invention provides a gaming machine system that allows for quick, secure and reliable authorization and access to sensitive gaming machine functions. The use of such a key eliminates the time consuming, labor intensive and expensive method of removing and installing EPROM(s) within current gaming machine control systems.

Although the invention has been described with reference to specific exemplary embodiments, it will be appreciated that it is intended to cover all modifications and equivalents within the scope of the appended claims.

What is claimed is:

1. A key for use with a gaming machine for authorizing access to a gaming machine control system for controlling the presentation of games on said gaming machine and performance of at least one other restricted function of the gaming machine via the control system, the key comprising:

a body;

connection means for connection of the key to a communication port mounted to a control system housing enclosing the control system wherein the control system housing is located within an interior of the gaming machine and wherein at least a main door of the gaming machine is opened to access the control system housing, the connection means being couple to the body;

non-volatile memory means, the non-volatile memory means being coupled to the body and being configured to authorize the control system to allow a user to perform at least one restricted function; and modifiable memory means coupled to the body for receiving information from the control system;

wherein the at least one restricted function comprises at least one of changing paytables, changing games, verifying firmware, verifying software, automatically performing at least one designated function within the gaming machine, downloading to media from an external source and clearing RAM within the control system.

2. A key in accordance with claim 1 further comprising a processor coupled to the body.

3. A gaming machine system comprising:

a gaming machine comprising:

a housing;

a first door coupled to the housing and allowing access to an interior of said housing;

a display coupled to the housing; and at least one user input coupled to the housing;

a control system for controlling the presentation of games on said gaming machine mounted within the interior of said housing, said control system comprising:

a control system housing enclosing the control system;

a control system housing door;

a communication port mounted to the control system housing and in communication with the control system;

wherein at least the first door is opened to access the control system housing; and a key for authorizing access to the control system and performance of at least one restricted function of the gaming machine via the control system, the key comprising:

a body;

connection means for connection of the key to the communication port, the connection means being coupled to the body;

non-volatile memory means, the non-volatile memory means being coupled to the body and being configured to authorize the control system to allow a user to perform at least one restricted function; and modifiable memory means coupled to the body for receiving information from the control systems wherein the at least one restricted function comprises at least one of changing paytables, changing games, verifying firmware, verifying software, automatically performing at least one designated function within the gaming machine, downloading to media frog an external source, clearing RAM within the control system, and clearing content of a modifiable storage device.

4. A gaming machine in accordance with claim 3 wherein the key further comprises a processor coupled to the body.

5. A gaming machine system in accordance with claim 3 further comprising means for determining if the communication port has been tampered with.

6. A gaming machine system in accordance with claim 5 wherein the means for determining if the communication port has been tampered with comprises evidence tape placed over the communication port.

7. A gaming machine system in accordance with claim 5 wherein the means for determining if the communication port has been tampered with comprises a sensor.

8. A gaming machine system in accordance with claim 3 wherein the communication port comprises a universal serial bus port.

9. A gaming machine system in accordance with claim 8 further comprising means for determining if the communication port has been tampered with.

10. A gaming machine system in accordance with claim 9 wherein the means for determining if the communication port has been tampered with comprises evidence tape placed over the communication port.

11. A gaming machine system in accordance with claim 9 wherein the means for determining if the communication port has been tampered with comprises a sensor.

12. A gaming machine system in accordance with claim 3 wherein the communication port controls a lock of the door of the gaming machine and the key authorizes opening of the door.

13. A gaming machine system in accordance with claim 3 further comprising a computer that is in communication with the gaming machine, the computer including the communication port.

14. A method of controlling a gaming machine system, the method comprising:

providing a gaming machine system comprising:

a housing;

a first door coupled to the housing and allowing access to an interior of said housing;

a display coupled to the housing; and at least one user input coupled to the housing;

a control system for controlling the presentation of games on said gaming machine mounted within the interior of said housing said control system comprising:

(i) a control system housing;

(ii) a control system housing door enclosing the control system;

(iii) a communication port mounted to the control system housing and in communication with the control system wherein at least the first door is opened to access the control system housing; and a key for authorizing access to the control system and performance of at least one restricted function of the gaming machine via the control system, the key comprising:

(a) a body;

(b) connection means for connection of the key to the communication port, the connection means being coupled to the body;

(c) non-volatile memory means, the non-volatile memory means being coupled to the body and being configured to authorize the control system to allow a user to perform at least one restricted function; and (d) modifiable memory means coupled to the body;

opening at least the first door; inserting the key into the communication port;

authorizing a performance of at least one restricted function;

performing the at least one restricted function; and transmitting information from the control system and receiving the information at the modifiable memory means;

wherein the at least one restricted function comprises performing at least one of changing paytables, changing games, verifying firmware, verifying software, automatically performing at least one designated function within the gaming machine, downloading to media from an external source, clearing RAM within the control system and clearing content of a modifiable storage device.

15. A method in accordance with claim 14 further comprising determining if the communication port has been tampered with prior to inserting the key.

16. A method in accordance with claim 14 wherein the communication port controls a lock of the control system housing door and the at least one function further comprises opening of the door.

17. The gaming machine of claim 3, wherein the communication port is located in an interior of the control system housing and wherein access to said interior is provided by the control system housing door.

18. The gaming machine of claim 3, wherein the communication port is used as part of a locking mechanism for the control system housing door.

19. The gaming machine of claim 3, wherein after access is authorized by said key, the display is used to display a list of one or more restricted functions for performance by the control system.

20. The gaming machine of claim 3, wherein the user input is a touch screen mounted to said display.

21. The method in accordance with claim 14, further comprising: displaying a list of one or more restricted functions to the display.

22. The method in accordance with claim 14, wherein the at the at least one restricted function is performed using a touch screen mounted to said display.

* * * * *